US006442923B1

(12) United States Patent
Weiss et al.

(10) Patent No.: US 6,442,923 B1
(45) Date of Patent: Sep. 3, 2002

(54) METHOD AND APPARATUS FOR GENERATING A YARN COMPOSED OF AT LEAST TWO YARN COMPONENTS

(75) Inventors: Hans-Joachim Weiss, Ulisbach; Jörg Maier, Winterthur; Werner Nabulon, Rüdlingen, all of (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/586,383

(22) Filed: Jun. 2, 2000

Related U.S. Application Data

(63) Continuation of application No. 09/031,460, filed on Feb. 26, 1998, now Pat. No. 6,076,345.

(30) Foreign Application Priority Data

| | | |
|---|---|---|
| Feb. 26, 1997 | (CH) | 0441/97 |
| May 23, 1997 | (CH) | 1201/97 |
| Nov. 21, 1997 | (CH) | 2703/97 |

(51) Int. Cl.[7] ..... D02G 1/16
(52) U.S. Cl. ..... 57/350
(58) Field of Search ..... 57/282, 284, 287, 57/288, 289, 290, 332, 333, 334, 337, 350, 351

(56) References Cited

U.S. PATENT DOCUMENTS

| | | | |
|---|---|---|---|
| 3,199,281 | A | 8/1965 | Maerov et al. |
| 3,255,508 | A | 6/1966 | Weiss et al. |
| 3,364,537 | A | 1/1968 | Bunting et al. |
| 3,426,406 | A | 2/1969 | McCutchan, Jr. |

(List continued on next page.)

FOREIGN PATENT DOCUMENTS

| | | | |
|---|---|---|---|
| CH | 680140 | A5 | 6/1992 |
| EP | 0039763 | B1 | 11/1981 |

(List continued on next page.)

OTHER PUBLICATIONS

Continuous Spin–Draw–Texturizing, IFJ, Oct., 1991.

Use Of 'Air Jets' In Yarn Texturizing Processes, IFJ, Feb., 1989.

ITMA 1995: Production of Filament Yarns and Staple Fibers, CFI, 12/95, V.45.

Production and Testing of Tanglelaced Yarns, vol. 36/88—May, 1986, Chemiefasem Textilindustrie.

Intermingling/Interlacing: A Broad Survey, Chemiefasern/Textilindustrie vol. 40/92, Jun., 1990.

European Patent Office Search Report, Oct. 9, 1997.

European Patent Office Search Report, Jul. 16, 1998.

U.S. application No. 09/165,627, filed Oct. 1, 1998.

*Primary Examiner*—Danny Worrell
*Assistant Examiner*—Shaun R Hurley
(74) *Attorney, Agent, or Firm*—Dority & Manning

(57) ABSTRACT

A method is provided for producing a yarn from at least two individual yarn components having different physical characteristics so that the produced yarn has a desired visual effect. The method includes continuously supplying at least one yarn component in the form of a bundle of continuous filaments and individually treating the bundle of continuous filaments in a treating stage. The treated bundle of continuous filaments is then conveyed to a collective compacting stage. At least one other yarn component is supplied from a spinning beam or a bobbin directly to the collecting compacting stage and the bundle of continuous filaments and at least one other yarn component are compacted collectively in a collective compacting device.

7 Claims, 6 Drawing Sheets

U.S. PATENT DOCUMENTS

| | | | | | |
|---|---|---|---|---|---|
| 3,479,810 | A | | 11/1969 | Eshuis | |
| 3,827,113 | A | | 8/1974 | Vidal et al. | |
| 3,846,881 | A | | 11/1974 | Erickson | |
| 3,982,310 | A | | 9/1976 | Beck et al. | |
| 4,025,595 | A | | 5/1977 | Mirhej | |
| 4,038,811 | A | | 8/1977 | Ansin et al. | |
| 4,064,686 | A | | 12/1977 | Whitted et al. | |
| 4,069,565 | A | | 1/1978 | Negishi et al. | |
| 4,118,843 | A | | 10/1978 | Schippers et al. | |
| 4,164,836 | A | | 8/1979 | Tanae et al. | |
| 4,218,869 | A | | 8/1980 | Newton | |
| 4,219,997 | A | * | 9/1980 | Hatcher | 57/245 |
| 4,268,940 | A | | 5/1981 | Kuroda et al. | |
| 4,280,261 | A | | 7/1981 | Nelson | |
| 4,299,015 | A | | 11/1981 | Marcus et al. | |
| 4,304,092 | A | | 12/1981 | Bridges et al. | |
| 4,319,447 | A | | 3/1982 | Barron | |
| 4,341,063 | A | | 7/1982 | Southerlin et al. | |
| 4,368,612 | A | | 1/1983 | Eschenbach | |
| RE31,376 | E | | 9/1983 | Sheenan et al. | |
| 4,467,594 | A | | 8/1984 | Eschenbach | |
| 4,522,774 | A | | 6/1985 | Donnelly et al. | |
| 4,570,312 | A | | 2/1986 | Whitener, Jr. | |
| 4,574,578 | A | | 3/1986 | Scott | |
| 4,610,131 | A | | 9/1986 | Eschenbach et al. | |
| 4,615,167 | A | | 10/1986 | Greenberg | |
| 4,644,622 | A | | 2/1987 | Bauer et al. | |
| 4,841,606 | A | | 6/1989 | Coons, III | |
| 4,894,894 | A | * | 1/1990 | Coons et al. | 28/220 |
| 4,897,989 | A | * | 2/1990 | Gray | 57/239 |
| 4,993,130 | A | | 2/1991 | Coons, III et al. | |
| 4,993,218 | A | | 2/1991 | Schwartz et al. | |
| 5,148,586 | A | | 9/1992 | Coons, III | |
| 5,184,381 | A | | 2/1993 | Coons, III et al. | |
| 5,195,313 | A | | 3/1993 | Coons, III | |
| 5,220,778 | A | | 6/1993 | Flachmueller et al. | |
| 5,221,059 | A | | 6/1993 | Coons, III et al. | |
| 5,251,363 | A | | 10/1993 | Gerhards et al. | |
| 5,299,345 | A | | 4/1994 | Flachmueller et al. | |
| 5,325,572 | A | | 7/1994 | Dickson, III et al. | |
| 5,327,622 | A | | 7/1994 | Coons et al. | |
| 5,379,500 | A | | 1/1995 | Flachmueller et al. | |
| 5,581,858 | A | | 12/1996 | Curran et al. | |
| 5,613,285 | A | | 3/1997 | Chester et al. | |
| 5,645,782 | A | | 7/1997 | Howell et al. | |
| 5,662,980 | A | | 9/1997 | Howell et al. | |
| 5,715,584 | A | | 2/1998 | Coons, III et al. | |
| 5,775,087 | A | | 7/1998 | Goineau | |
| 6,076,345 | A | * | 6/2000 | Weiss et al. | 57/333 |

FOREIGN PATENT DOCUMENTS

| | | | |
|---|---|---|---|
| EP | 0110359 | B1 | 6/1984 |
| EP | 0123072 | B1 | 10/1984 |
| EP | 0123829 | B1 | 11/1984 |
| EP | 0133198 | B1 | 2/1985 |
| EP | 0310890 | A1 | 4/1989 |
| EP | 0434601 | A1 | 6/1991 |
| EP | 0485871 | | 5/1992 |
| EP | 0498054 | A1 | 8/1992 |
| EP | 0745711 | A1 | 12/1996 |
| EP | 0784109 | A2 | 7/1997 |
| EP | 0848095 | A1 | 6/1998 |
| FR | 1575307 | | 7/1969 |
| FR | 2190957 | | 1/1974 |
| GB | 1381937 | | 1/1975 |
| JP | 2300344 | | 12/1990 |
| WO | 9609425 | | 3/1996 |
| WO | WO9731141 | | 8/1997 |

* cited by examiner

Fig.5
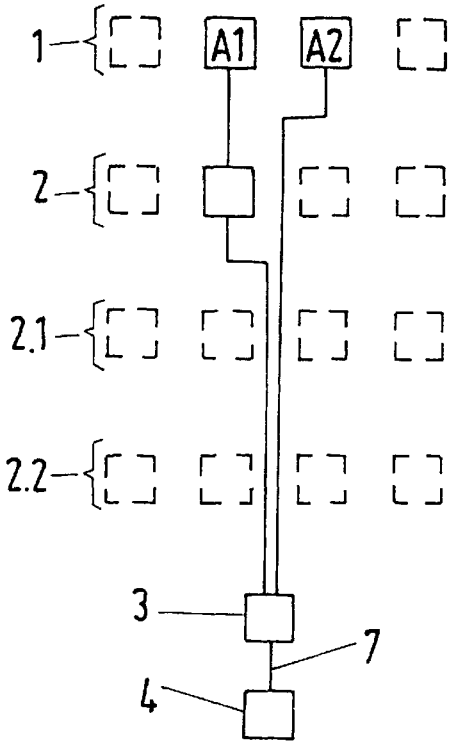
Fig.6
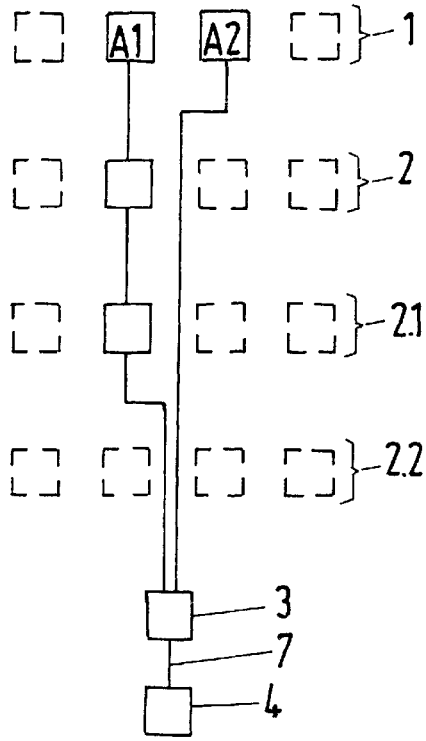
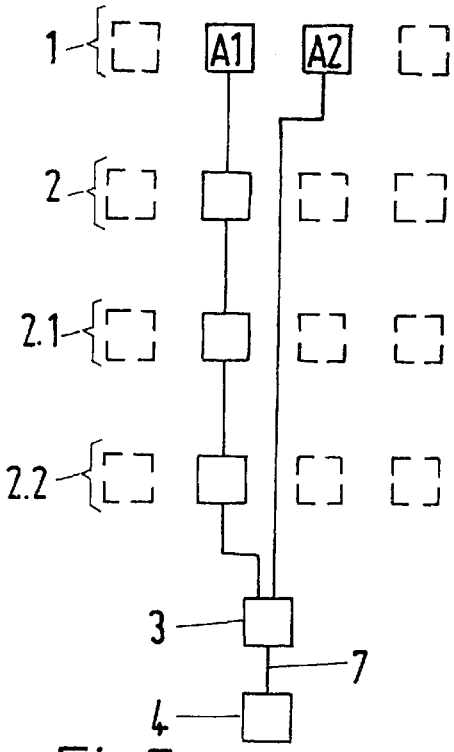
Fig.7
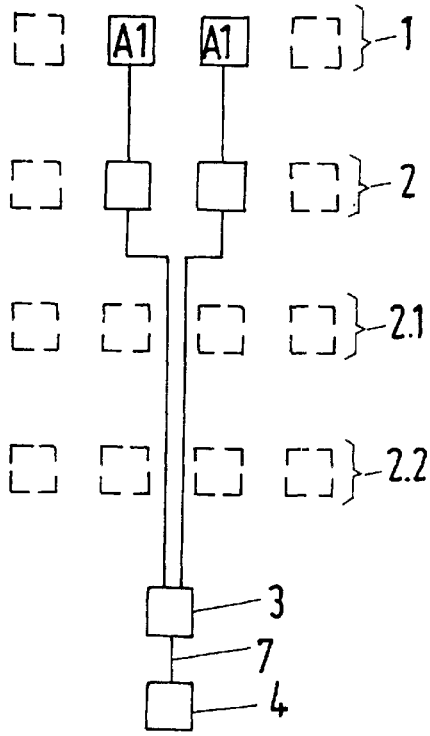
Fig.8

Fig.9
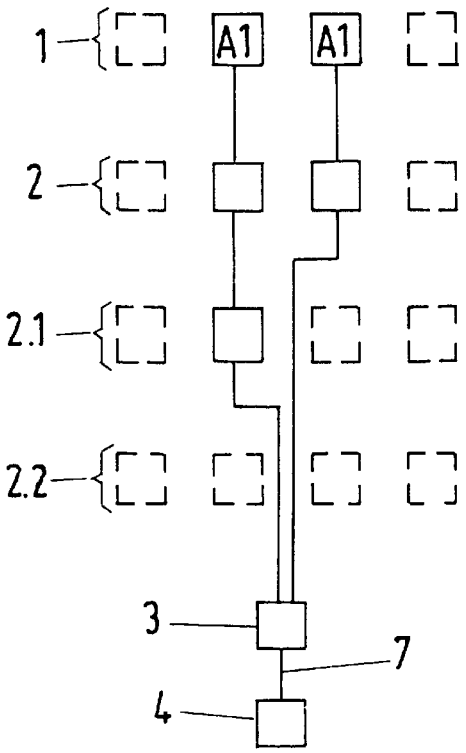
Fig.10
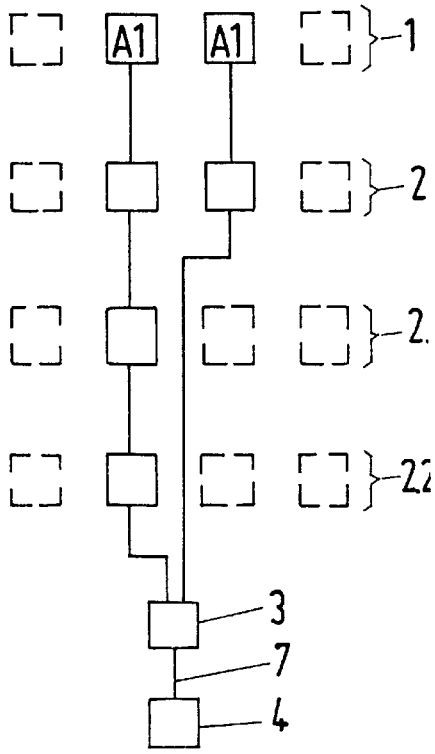
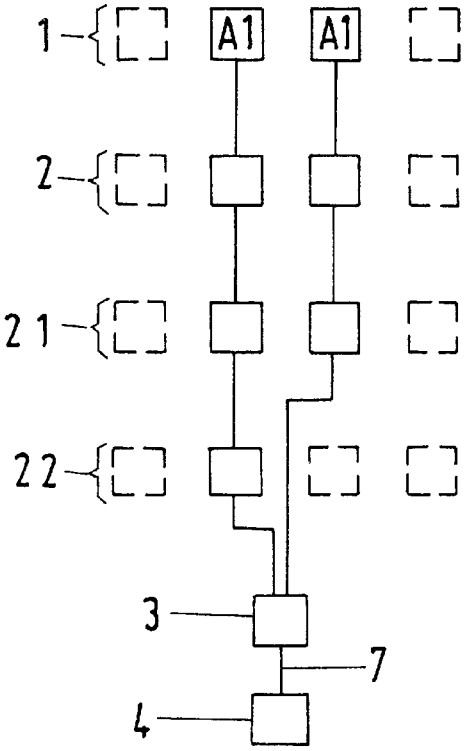
Fig.11
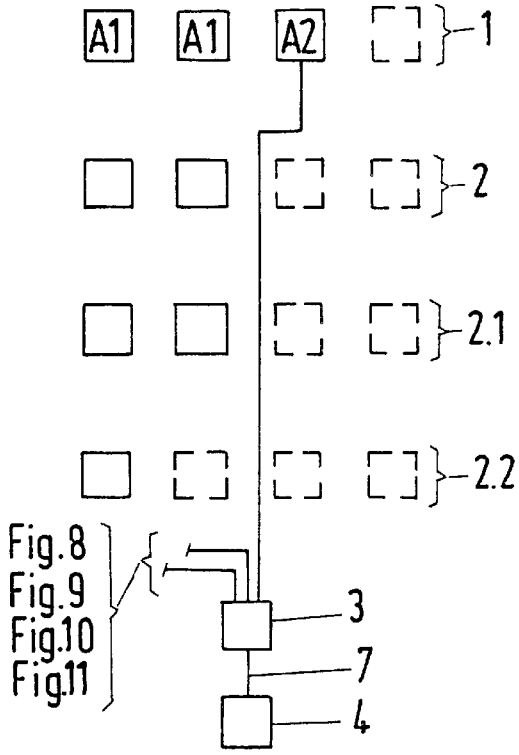
Fig.12

Fig.13
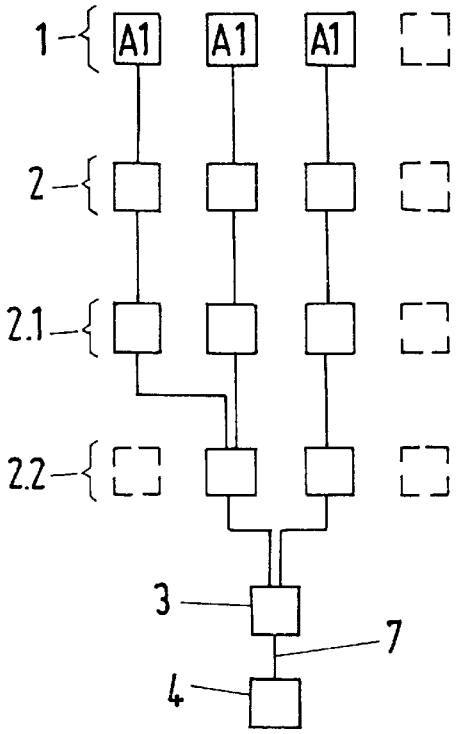
Fig.14
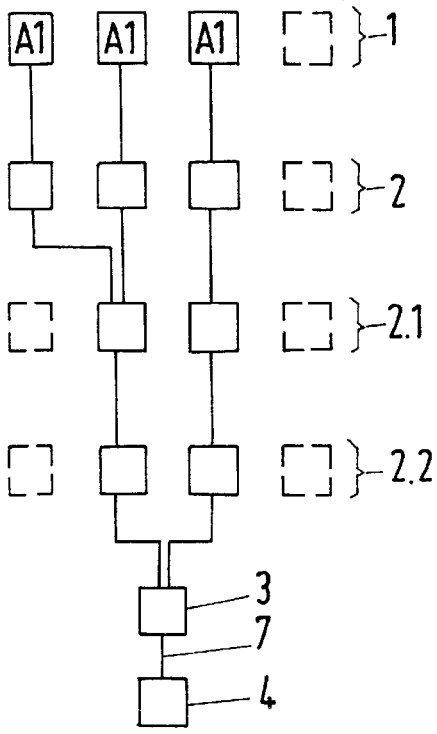
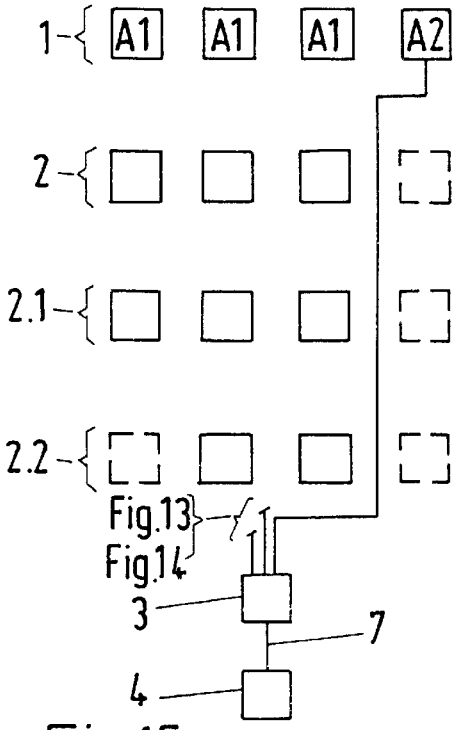
Fig.15
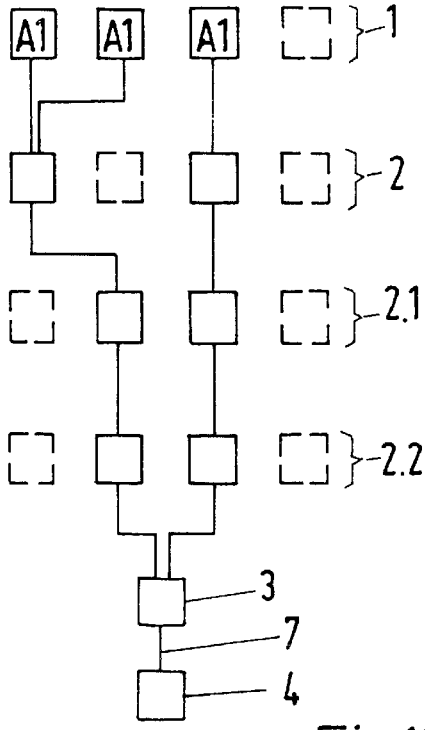
Fig.16

Fig.17
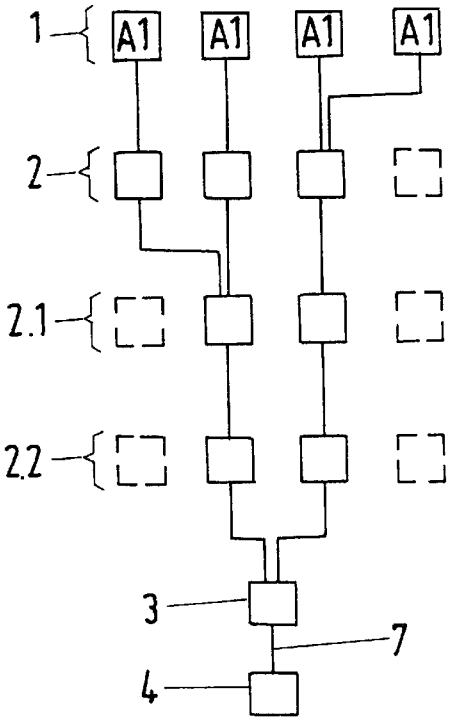
Fig.18
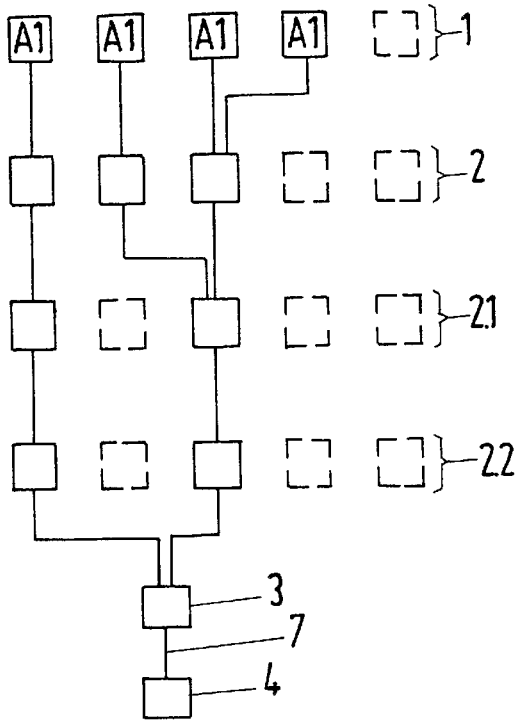
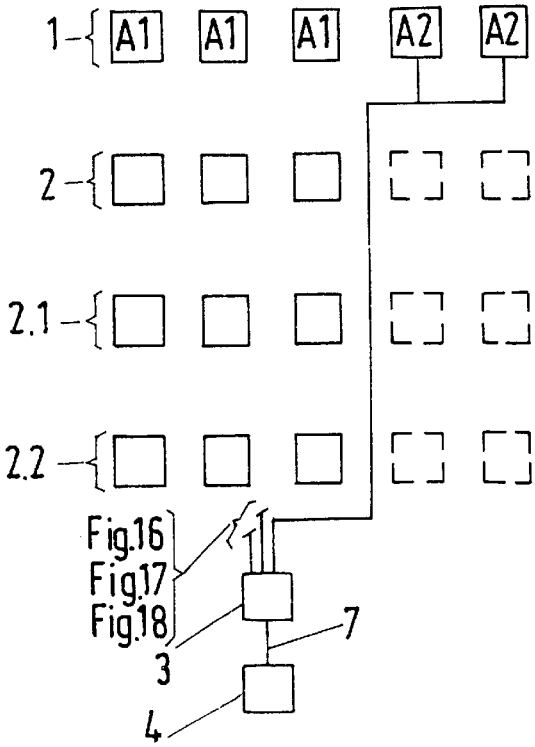
Fig.19
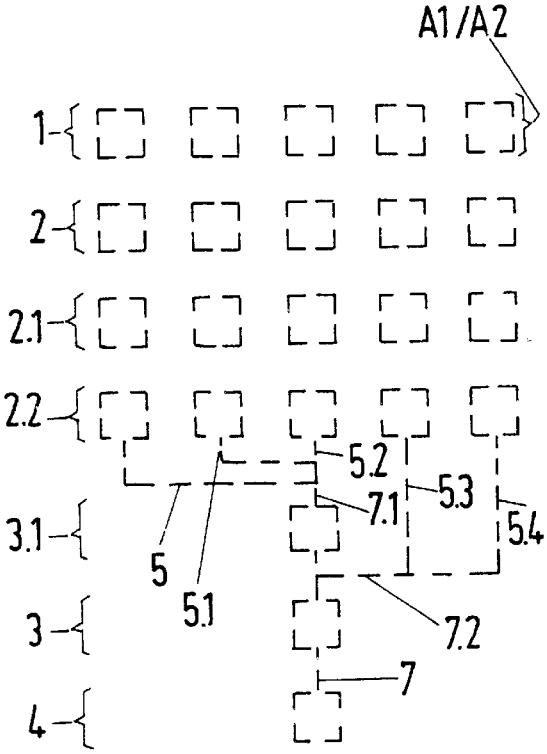
Fig.20

METHOD AND APPARATUS FOR GENERATING A YARN COMPOSED OF AT LEAST TWO YARN COMPONENTS

The present application is a Continuation Application of U.S. application Ser. No. 09/031,460 filed Feb. 26, 1998, now U.S. Pat. No. 6,076,345.

BACKGROUND OF THE INVENTION

The present invention concerns a method for generating a yarn composed of at least two yarn components, wherein the yarn components in a last processing stage upstream from a collecting stage jointly are compacted into a yarn, and an apparatus for generating a yarn composed of at least two yarn components.

From the European Patent Application No. 0434 601 A1, a method and an apparatus are known for producing a non-twined yarn composed of at least two bundles of fibrils arranged constantly with respect to each other, in which arrangement the bundles of fibrils, called yarn components in the context of this description, each are treated separately in a processing stage each before being drawn, and after drawing are textured jointly. According to common knowledge, the textured yarn subsequently is entangled furthermore in such a manner that the bulked character of the yarn is adapted into a yarn suitable for further processing. In this arrangement, the processing stage upstream from the drawing stage consists of an entangling stage, or a false-twisting stage, in which the individual fibrils of the yarn components are compacted whereby it is rendered possible to keep the distances between the individual yarn components as small as possible without inter-entangling the outermost fibrils of the individual yarn components, which can result in disturbances or at least in an intermingling of the yarn components.

From a further European Patent document EP 485 871B1, a method and an apparatus are known for generating a texturized multicoloured yarn in which arrangement the individual colours are supplied separately from an extruder beam each and cooled, and subsequently are separately guided via an oiling device each and subsequently are guided separately through entangling nozzles each. In this arrangement, the entangling process is effected in such a manner that the entanglement is dissolved in the subsequent drawing process at least to a large extent. The entanglement is aimed at compacting the individual bundles of fibrils, also called yarn components, in such a manner that the individual bundles of fibrils are mutually intermingled in such a manner that the colour separation in the final yarn is disturbed. The drawn bundles of fibrils subsequently are directly textured jointly, cooled and jointly are entangled in an entangling device and subsequently are wound up in a package. The last mentioned entanglement is a collective entanglement, i.e. an interconnection of the three part-threads in such a manner that an actually coherent yarn is generated which can be wound up.

From the European Patent Application with the Publication No. EP .0784109 A2, it can be seen that part-threads of different types, e.g. differently coloured or differently stainable part-threads, are supplied either from extrusion beams or from thread packages and before being drawn first are oiled each and subsequently are pre-compacted, and after the drawing stage are textured either jointly in a common texturizing device, or individually each in a texturizing device. Downstream from the texturizing device, the plug emerging from the texturizing device is cooled, which cooling can be effected, at least partially, already within the texturizing device towards the exit end of the texturizing device.

After cooling of the plug, the part-threads each in an after-compacting stage preferentially are entangled and subsequently are jointly entangled again, i.e. combined, in a collective entanglement stage in such a manner that a yarn is formed from the part-threads which can be wound up.

In this arrangement various types of texturing devices as well as devices for generating a corresponding yarn are shown and described to which the present application refers to, and EP 0784109 A2 therefore is considered as an integral part of the present Patent Application and is thus incorporated herein by reference.

OBJECTS AND SUMMARY OF THE INVENTION

It is the goal of the present invention to guide the individual yarn components and to treat these yarn components distinctly and pre-determinably to the stage of common compacting in order to influence the yarn character generated after the common compacting stage. Additional objects and advantages of the invention will be set forth in part in the following description, or may be obvious from the description, or may be learned through practice of the invention.

According to the present invention, the goals are achieved in a method in which at least one yarn component passes through at least one processing stage, known as such, before this yarn component passes jointly with the further treated or untreated yarn component or components through a last treatment stage and subsequently are collected as a yarn in the collecting stage, whereas in the apparatus at least two treating stages are provided which can be used as desired and in which at least one compacting stage and one collecting stage for a yarn consisting of two yarn components are provided.

In this arrangement, the yarn components can be freshly spun and drawn yarn components or can be drawn yarn components taken from a package. The yarn components also can have undergone already a pre-compacting process in the form of an entanglement or of a false twist process.

Furthermore, the yarn components can present further and differing characteristics as to the type and/or the structure and/or the colour of the yarn components. In this context, the type concerns differences in linear density (tex), or in the number of fibrils in the yarn components, or in the polymer type, or in the stainability, or in the cross-section of the fibrils, or in the additives in the fibrils and the structure as to changes, or differences respectively, in their crystalline or molecular structure.

Within the scope of the present invention, there still is the possibility of combining untreated and treated yarn components in the common compacting stage in order to influence the yarn character.

Furthermore, an untreated yarn component also can be understood to be a staple fibre yarn spun from man-made or from natural fibres, which upstream from the collecting stage, i.e. upstream from the winding up stage of the finished yarn, is compacted jointly with the other yarn components.

Treatment of the individual yarn component can consist of any texturing process known as such, any entangling process known as such, any false twist process known as such, or any other known method, which in the yarn component effects a type of change in structure and/or form of the individual fibrils in the yarn component.

As said yarn components, except the staple fibre yarn components mentioned, are already drawn, the individual yarn components in an immediately following inventive treatment, also called "on line" treatment, can be, e.g., texturized each separately and after the texturizing process can be jointly compacted, preferentially entangled in such a manner that a yarn ready to be wound up is generated.

In this arrangement also either texturizing nozzles of the same type can be supplied with different gas pressures or at different temperatures or with different gas quantities per unit time, or additionally there is the possibility to choose for at least one yarn component a different texturizing nozzle which also can be operated in the manner described above.

There also is the possibility to maintain different thread tensions, to be described in the following with reference to the Figures, in the individual yarn components upstream from and/or in the common texturizing process in order to achieve variations in the yarn character after the compacting stage.

Furthermore, guidance, to be described in the following with reference to the Figures, of the individual yarn components in the compacting stage can be kept different in order to keep the influence of the compacting process onto the individual yarn components different in such a manner that an influence on the yarn after the compacting process is obtained.

In a further alternative solution, at least one treated yarn component is combined in the common compacting stage with at least one untreated yarn component in order to influence the yarn character resulting after the compacting stage.

In principle it is to be noticed that the yarn components are kept separate until they reach the collective compacting stage in order to obtain as many possible influences on the finished yarn as possible; in order to either simplify the method or to further differentiate the character, or the structure respectively, of the finished yarn, and within the method yarn components can be guided jointly through a treating stage.

The present invention thus is neither limited to the treating means mentioned nor to the compacting means mentioned, as any treating or compacting means desired can be used in the application of the inventive method.

The present invention thus is not restricted to the elements shown and described.

BRIEF DESCRIPTION OF THE DRAWINGS

FIG. 5 is a diagrammatic view of a yarn processing arrangement according to the present invention;

FIG. 6 is an alternative diagrammatic view of a yarn processing arrangement according to the invention;

FIG. 7 is an alternative diagrammatic view of a yarn processing arrangement according to the invention;

FIG. 8 is an alternative diagrammatic view of a yarn processing arrangement according to the invention;

FIG. 9 is an alternative diagrammatic view of a yarn processing arrangement according to the invention;

FIG. 10 is an alternative diagrammatic view of a yarn processing arrangement according to the invention;

FIG. 11 is an alternative diagrammatic view of a yarn processing arrangement according to the invention;

FIG. 12 is an alternative diagrammatic view of a yarn processing arrangement according to the invention;

FIG. 13 is an alternative diagrammatic view of a yarn processing arrangement according to the invention;

FIG. 14 is an alternative diagrammatic view of a yarn processing arrangement according to the invention;

FIG. 15 is an alternative diagrammatic view of a yarn processing arrangement according to the invention;

FIG. 16 is an alternative diagrammatic view of a yarn processing arrangement according to the invention;

FIG. 17 is an alternative diagrammatic view of a yarn processing arrangement according to the invention;

FIG. 18 is an alternative diagrammatic view of a yarn processing arrangement according to the invention;

FIG. 19 is an alternative diagrammatic view of a yarn processing arrangement according to the invention; and FIG. 20 is an alternative diagrammatic view of a yarn processing arrangement according to the invention.

DETAILED DESCRIPTION

The present preferred embodiments of the invention are described in the following with reference to the FIGS. 1 through 20 purely schematically and in the sense of examples merely. It should be understood that various modifications and variations can be made in the invention without departing from the scope and spirit of the invention. For example, features illustrated or described as part of one embodiment can be used in another embodiment to yield still a further embodiment. It is intended that the present invention include such modifications and variations.

Figure 1:
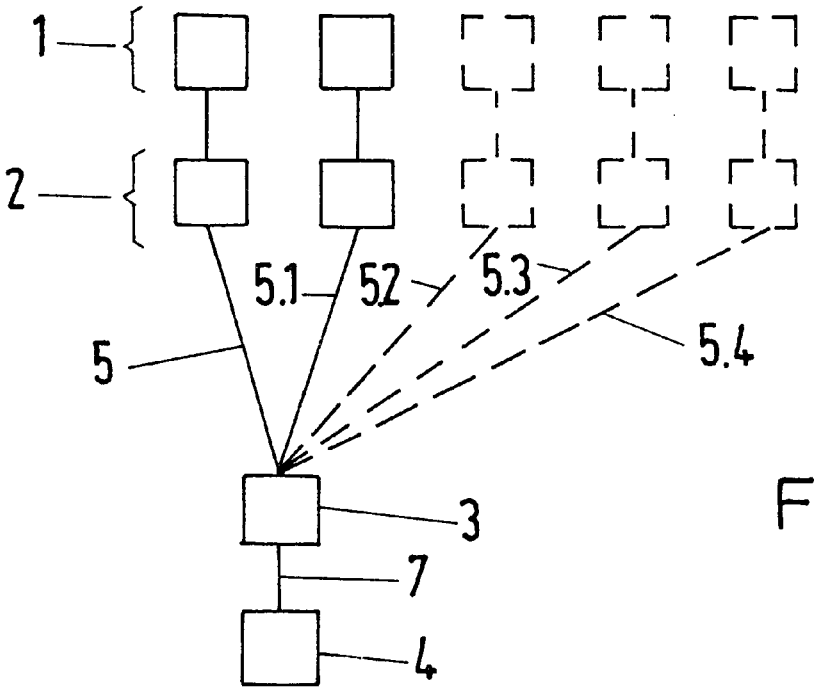
FIG. 1 is a diagrammatic view of a yarn processing apparatus from a supply of yarn components to a collecting stage.

In the FIG. 1 the row designated 1 concerns the supply of yarn components in which each component supplied either is a yarn component supplied from an extrusion beam and drawn on-line or a drawn yarn component supplied from a package.

The reference number 2 designates a row of treating stages in which arrangement, as shown in the FIG. 1, a separate treating device each being provided for each yarn component.

A common compacting stage designated with the reference number 3, as shown in the FIG. 1, jointly treats all yarn components 5 through 5.4, which subsequently are transferred to the collecting stage 4 as a yarn 7. This collecting stage 4 represents a winding device.

Figure 2:
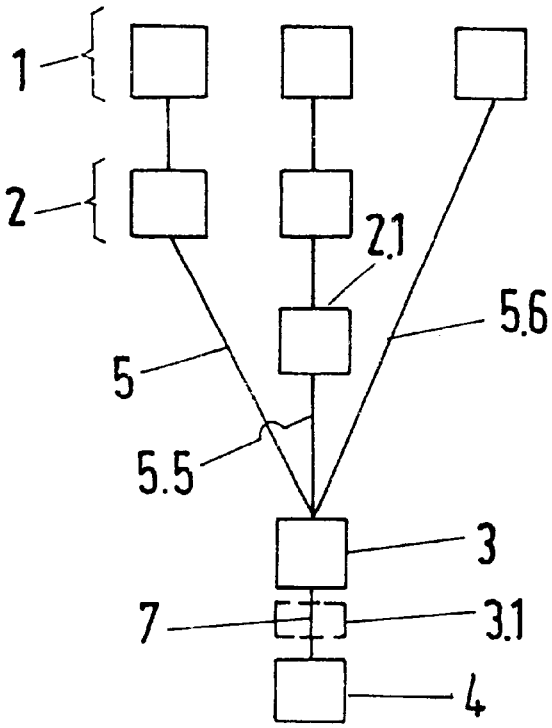
FIG. 2 is a schematic view of a yarn processing arrangement illustrating a variation of treating stages for individual yarn components.

As shown in the FIG. 2, the individual yarn components can pass through none or through more than one of the treating stages before the individual yarn components are combined in the compacting stage 3 into a yarn 7.1.

In this arrangement, the yarn component 5 is assumed to be treated in one treating stage, the yarn component 5.5 in two treating stages, and the yarn component 5.6 in none of the treating stages.

Furthermore, the yarn component 5.6 can be either a multi-filament yarn or also a staple fibre yarn or any other non-multi-filament yarn type desired.

The multi-filament yarn can be a yarn already texturized or treated otherwise, or can be any other yarn presenting any yarn characteristic which is suitable to be compacted jointly with at least one other yarn component in a compacting stage.

If, as mentioned above, in the FIG. 2 the yarn component 5.6 as an alternative is a yarn component which is not to be treated further and which can be compacted jointly with other yarn components, as a rule the yarn components 1 supplied are yarn components which under certain circumstances possibly have been pre-compacted already and as a rule are drawn but as a rule not texturized, the treating stage 2 thus being the first treating stage for yarn components of this type.

Subsequently, as shown in the FIG. 2, a further treating stage 2.1, which e.g. can be a so-called after-compacting device, can be provided for one yarn component which subsequently is combined with the two other yarn components in the collective compacting device into a yarn 7.

Furthermore, there is the possibility to effect the collective compacting twice or more times, which in the FIG. 2 is indicated by the rectangle 3.1 shown with broken lines.

The same applies where, in the treating stage 2.1 an after-compacting process is effected, i.e. an after-compacting process also here can be effected twice or more times, just as it applies for the collective compacting process 3.1.

If in the treating stage 2 a texturizing process is effected, known texturizing devices or texturizing methods of any type can be used. The type of the texturizing method, and of the texturizing device respectively, is not an important feature of the present invention.

The same applies if in the treating stages 2 or 2.1, or 3 or 3.1, an entangling process is effected, where known entangling devices or entangling methods of any type can be used. The type of the entangling method, and of the entangling device respectively, is not an important feature of the present invention.

The same applies if in the treating stages 2 or 2.1, or 3 or 3.1, a false twist process is effected, where known false twisting stages of any type can be used as the type is not an important feature of the present invention.

The same applies also to the collecting stages, i.e. any type of winding devices known as such or any type of collecting stages not mentioned herein can be applied.

Also, one is free to operate the treating stages mentioned above, and the collective compacting stages mentioned above respectively, differently by varying the temperature, the quantity (kg/h), and the pressure of the treating gas.

Figure 3:
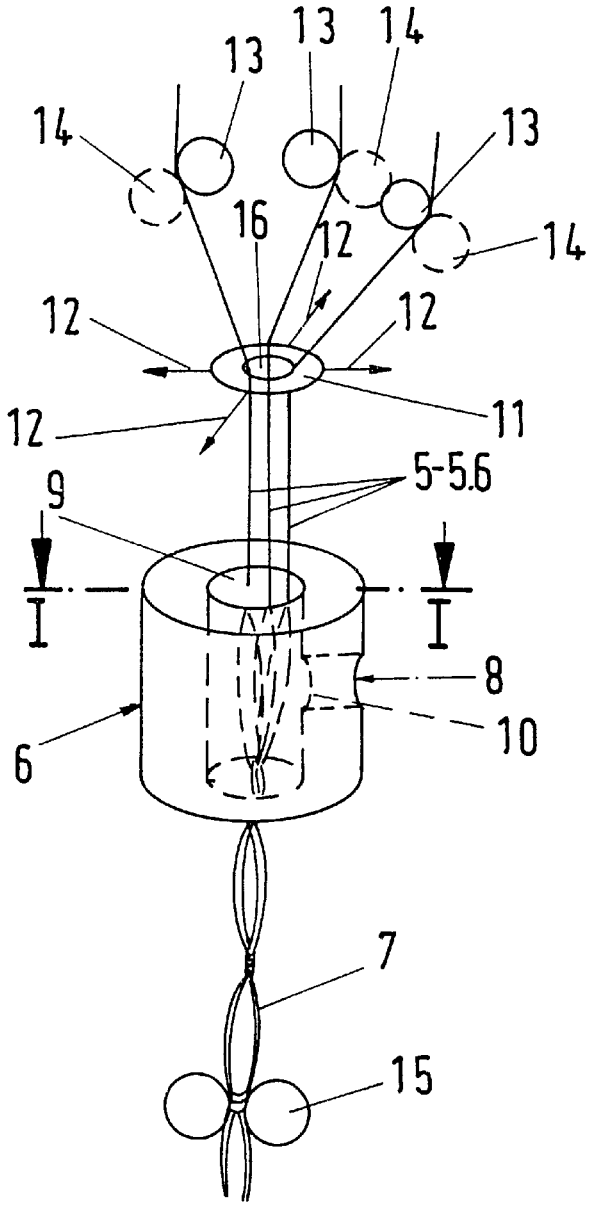
FIG. 3 is a partial operational and diagrammatic view of an entangling nozzle for use in a compacting stage according to the invention.

In the FIG. 3 an example is shown of an entangling nozzle which can be used in the compacting stage 3 or 3.1 respectively. This entangling nozzle corresponds to an entangling nozzle of the Heberlein Company at Wattwil, Switzerland. It is understood in this context, as mentioned earlier already, that any entangling nozzle or a false twist nozzle of any make can be considered.

In the FIG. 3, the entangling nozzle is designated with the reference number 6, the entry opening for the yarn components with the reference number 9, and the gas entering the nozzle with the reference number 8.

Figure 4:
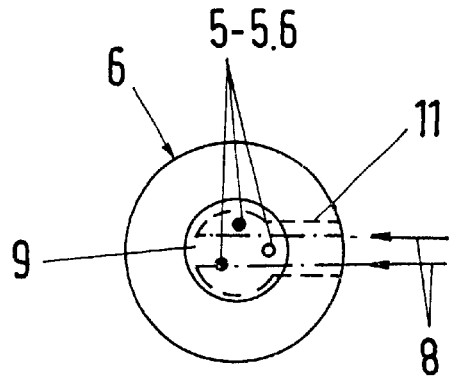
FIG. 4 is a view of the entangling nozzle taken along the lines indicated in FIG. 3.

As can be seen in the yarn transporting direction, the entangling nozzle is preceded by a guide ring 11 which serves as a guide element for the yarn components 5 to 5.6 which, as shown in the FIG. 4, guiding these yarn components each to a different position in the entry opening 9 of the entangling nozzle in such a manner that the yarn components 5 to 5.6 are subject to different entangling effects. Three yarn components e.g. are shown in this FIG. 4, where in principle the number of yarn components is at least two and where, as mentioned already, any of the yarn components mentioned before can be processed.

The guide ring 11 can be shifted in its position, as indicated with the shifting devices 12, by means of respective, but here not shown means, in such a manner that the position of the yarn components is changed.

Furthermore, the opening 16 of the guide ring 11 can be formed circular or oval or in any other shape desired in order to obtain different positions of the yarn components in the opening 9, provided the positions of the guide rolls arranged upstream from the guide ring 11 themselves can not be changed for adapting the positions of the yarn components 5 to 5.6 in the opening 9 jointly with the guide ring 11.

The clamping rolls 14 facing the guide rolls 13, with which they form pairs of clamping rolls, indicate that in combination with a pair of take-off rolls 15 provided downstream from the entangling nozzle, the tension in each yarn components 5 to 5.6 can be kept by the same or different respective means.

In this arrangement, this yarn tension in each yarn component alone or in combination with the various positions of the yarn components can serve for obtaining a different yarn character of the yarn 7.

In the FIG. 4, a top view of the entangling nozzle 6 is shown along the line I—I according to the FIG. 3.

In the FIG. 4, the yarn components 5 to 5.6 are shown as an example with 3 yarn components. The gas entry is indicated with the gas 8 as shown in connection also with entangling nozzles of the Heberlein Company mentioned above.

In the FIGS. 5 through 20, variations are shown of the application of the treating stages for treating of equal or differing yarn components.

The treating stages are shown described already in the European Patent Application No. EP 0784109 A2 which document thus is an integral part of the present application.

In the FIGS. 5 through 20, the same reference signs in part are applied as in the FIGS. 1 and 2 which together with the FIGS. 3 and 4 are shown and described already in the earlier Swiss Patent Application No. CH 0441/97.

The squares designated with the reference number 1 represent yarn components of a endless filament bundle either supplied, from an extrusion beam or from a package, or of a staple fibre yarn component which can be spun from man made fibres or from natural fibres.

The squares designated with the reference number 2 concern a pre-compacting process shown and described in the above mentioned European Patent Application EP-0784109 A2, whereas 2.1 represents a texturizing process stage and 2.2 represents an after-texturizing process stage, which both also are described in the above mentioned Euro-Application.

The drawing stages designated with 4, and being shown between the pre-compacting process stage and the texturizing process stage, shown and described in the above mentioned European Patent Application, being as well as the draw rolls designated 33, 34 and 35 in the above mentioned European Patent Application which, are not shown here for the sake of simplicity, where in the last-mentioned rolls according to the European Patent Application are optional elements, however the drawing stages are only optional if the yarn components are supplied from bobbins.

All processing stages, as mentioned already in the introduction to the present application, can be operated differently in order to obtain variations in the yarn character, and in the fabric produced therefrom respectively, e.g. in a carpet, In the FIG. 5 the reference sign Al indicates that a filament bundle from an extrusion beam is treated in a pre-compacting process stage 2 and jointly with a filament bundle A2 from a package of pre-drawn filament is compacted in the collective compacting process stage 3 and subsequently is wound up as a yarn 7 in a collecting stage, e.g. in a winding device.

Instead of a filament bundle from a package with pre-drawn synthetic filament, either a man-made or a natural fibre staple yarn can be compacted jointly with the filament bundle from the extrusion beam in the collective compacting stage 3 and be wound up as a yarn 7 in the collecting stage 4.

In principle, the filament bundles always are collected as a yarn 7 after the collective compacting stage 3 in the collecting stage 4, and therefore in the descriptions referring to the further Figures repetition of this collecting function is dispensed with.

The FIG. 6 differs from the FIG. 5 in that the filament bundle A1 from the extrusion beam after passing through the pre-compacting stage 2 passes through a texturizing stage 2.1 before this filament bundle is transferred with bundle or the yarn component from the package A2 into the collective compacting stage 3.

In the FIG. 7 the filament bundle A1 supplied from the extrusion beam is shown, which is treated additionally, compared to the method indicated in the FIG. 6, after the texturizing stage 2.1 in the after-compacting stage 2.2, before this filament bundle is transferred with the filament bundle or with the yarn from the package A2 into the collective compacting stage 3.

In the FIG. 8 two filament bundles each supplied from an extrusion beam are shown, each of which is compacted separately in the pre-compacting stage 2, whereupon the two bundles in the collective compacting stage 3 jointly are compacted into a yarn 7.

In the FIG. 9 two filament bundles A1 supplied from an extrusion beam each are shown, of which the filament bundle shown to the left hand side is processed through a pre-compacting stage 2 and a texturizing stage 2.1, before it is joined with the adjacent filament bundle, which merely is processed through the pre-compacting stage 2, in the collective compacting stage into a yarn 7.

In the FIG. 10 the filament bundle A1 shown to the left hand side after the pre-compacting 2 and the texturizing stage 2.1 is processed through an after-compacting stage 2.2, before it joins the filament bundle A1, shown to the right hand side, which was processed merely through a pre-compacting stage 2, and is compacted into a yarn 7 in the collective compacting stage 3.

The FIG. 11 shows, compared to FIG. 10, that the filament bundle A1 is additionally guided through the texturizing stage 2.1, after passing the pre-compacting stage 2 and before the two filament bundles are connected to a yarn 7 in the collective compacting stage 3.

In the FIG. 12 a filament bundle or a staple fibre yarn supplied from a package A2 is shown, where the staple fibre yarn can be spun from man made fibres or from natural fibres, which together with two filament bundles according to the FIGS. 8 or 9 or 10 or 11 is compacted into a yarn 7 in the collective compacting stage 3.

In the FIG. 13 three filament bundles A1 are shown which are supplied from an extrusion beam each, in which arrangement the filament bundle shown to the right hand side is processed alone through all treating stages 2, 2.1, 2.2 before reaching the collective compacting stage 3, whereas the filament bundle shown to the left and the filament bundle shown in the middle jointly are processed through the after-compacting stage 2.2 after having passed the pre-compacting stage 2 and the texturizing stage 2.1 and subsequently are compacted together with the filament bundle shown to the right hand side in the collective compacting stage 3 into a yarn 7.

In principle a "right hand side filament" in the context of this description is understood to be a filament bundle which, viewing the Figure, is shown to the right hand side of a corresponding middle filament bundle, or of a corresponding "left hand side filament bundle" in the corresponding Figure.

In the FIG. 14 an alternative solution, differing from the solution shown in the FIG. 13, is shown in which a left hand side filament bundle and a middle filament bundle after the pre-compacting stage 2 jointly are texturized in the stage 2.1 and subsequently are after-compacted in the stage 2.2, whereupon together with the right hand side filament bundle, which is processed through all treating stages 2 to 2.2, they are compacted into a yarn 7 in the collective compacting stage 3.

In the FIG. 15, a combination is shown of a filament bundle A2 consisting of synthetic fibres or of natural fibres, which in the collective compacting stage 3 is collectively compacted with filament bundles according to the FIG. 13 or to the FIG. 14 into a yarn 7.

In the FIG. 16, three filament bundles A1 are shown each supplied from an extrusion beam, where the right hand side filament bundle is processed alone through all the treating stages 2 to 2.2, whereas the middle fibre bundle and the left hand side filament bundle jointly are pre-compacted in the treating stage 2, and subsequently as a jointly pre-compacted filament bundle together are texturized in the stage 2.1 and after-compacted in the stage 2.2, before this joint filament bundle is compacted into a yarn 7 in the collective compacting stage 3.

In the FIG. 17, four filament bundles A1 are shown each being supplied from an extrusion beam, in which arrangement the two right hand side filament bundles jointly are pre-compacted in the stage 2 and subsequently as a joint fibre bundle are processed through the texturizing stage 2.1 and after that through the after-compacting stage 2.2, before this joint filament bundle and the two left hand side filament bundles together are collectively compacted into a yarn 7. In this arrangement, the two left hand side filament bundles each are pre-compacted separately in the stage 2 and subsequently are processed through the after-compacting stage 2.2, before this joint filament bundle and with the two left hand side filament bundles together are compacted in to a yarn 7. In this arrangement, the two left hand side filament bundles each are pre-compacted separately in the stage 2 and then are jointly texturized in the stage 2.1 and jointly are after-compacted in the stage 2.2, whereupon they are, as mentioned before, as a joint filament bundle are collectively compacted with the joint right hand side filament bundle in the stage 3.

In the FIG. 18, also four filament bundles A1 are shown supplied each form an extrusion beam, where the left hand side filament bundle alone is processed through all stages 2 to 2.2 before being compacted with a triple filament bundle combined from the three adjacent individual filament bundles in the collective compacting stage into a yarn 7. In this arrangement the triple filament bundle is composed of an individual filament bundle A1 and of a double filament bundle combined from two individual filament bundles Al, where the individual filament bundle is processed alone through the pre-compacting stage 2, the double filament bundle is processed jointly through a pre-compacting stage 2 each, and subsequently is jointly processed through the texturizing stage 2.1 and then through the after-compacting stage 2.2, and then before reaching the collective compacting stage 3 jointly is after-compacted in the stage 2.2.

In the FIG. 19, two right hand side yarns A2 are shown each supplied from a package, where one package can contain a staple fibre yarn spun from synthetic fibres and the other package A2 can contain a staple fibre yarn spun from natural fibres, or both packages can contain synthetic fibre staple yarns of different characteristics or can contain different natural fibre staple yarns. In this arrangement the collected staple yarn in a joint filament bundle together with the filament bundles indicated in the FIGS. 16 or 17 or 18 in the collective compacting stage 3 is compacted into a yarn 7.

The FIG. 20 indicates primarily that a further collective compacting stage 3.1 is provided, in which the yarn components 5, 5.1 and 5.2 are compacted into a pre-yarn 7.1, which together with a further pre-yarn 7.2 combined from the yarn components 5.3 and 5.4 is compacted in the last compacting stage 3 into a yarn 7 which then is collected in the collecting stage 4, where it is e.g. wound up.

The squares shown with dashed lines merely are to be understood as an indication that e.g. the individual yarn components according to the FIGS. 8, 9,10 and 11 are compacted in a compacting stage 3.1 into a pre-yarn, which then according to the FIG. 12 is compacted together with the single yarn component from the stage A2 in the compacting stage 3 into the yarn 7. The same applies for the yarn components according to the FIGS. 13 and 14 or to the FIGS. 16, 17 and 18, which each are compacted in a compacting stage 3.1 into a pre-yarn 7.1, where-upon this pre-yarn according to the FIGS. 12, 15 or 19 together with the single yarn component from the stage A2 according to the FIGS. 12 or 15, or together with the two yarn components from the two stages A2 according to the FIG. 19, are compacted into a yarn 7.

Also, further additional collective compacting stages, not shown here, can be provided in such a manner that more than two pre-yarns can be generated, which together can be compacted in the last collective compacting stage into a yarn 7.

It also is feasible to combine other alternative variations, not shown here, of the pre-yarns 7.1 or 7.2 respectively. Such pre-yarns can be composed, as in the examples shown in the FIGS. 1 through 19, of bundles of endless filaments and of staple fibre yarns, where among the filament bundles as well as among the staple yarns various types can be combined.

In principle in the FIG. 20, as in the FIGS. 1 and 2, as well as 5 through 19, the treating stages are designated with the reference numbers 1, 2, 2.1, 2.2, 3 and 4 as well as the additional treating stage 3.1, which can be provided as a single or as a multiple treating stage.

Furthermore, for all Figures shown, according to the European Patent Application EP 0784109A2 an oil application stage is to be provided between the stages 1 and 2 for all yarn components composed of fibril bundles. Furthermore the various treating stages such as gasdynamically falstwisting, entangling and gasdynamically texturizing can be operated according to the operation variants mentioned initially in order to additionally influence the yarn character of the finished yarn 7.

If among the pre-compacting stages 2, instead of a gasdynamic false twist device, a disc twisting device, or a friction twist device, using which pre-compacting can be effected, are applied, the variable operation parameters are variations in the rotational speeds of the disc twisting device, or variations of the surface roughness of the individual discs, or of the disc of the twisting device, or the wrapping angle of the filament bundle about the discs or the disc.

Accordingly there are means for varying said operation parameters, namely means for commanding the pressure, the quantity and the temperature of the texturizing medium, or means for varying said operation parameter of said disc twisting device or generally mechanical false twisting devices.

Finally the squares shown with dashed lines are indicating that further variants of combinations, which are not contained in the examples shown, are feasible within the scope of the present invention, the present invention therefore not being limited to the examples shown.

Furthermore the squares shown with dashed lines are an indication that the functions 2 to 2.2 are provided interchangeably, i.e. functions can be added or taken off in correspondence with the desired yarn character.

It should be appreciated by those skilled in the art that modifications and variations can be made in the present invention without departing from the scope and spirit of the invention. It is intended that the present invention include such modifications and variations as come within the scope of the appended claims and their equivalents.

What is claimed is:

1. A method for producing a yarn from at least two individual yarn components wherein at least one physical characteristic of the yarn components is different so as to produce a desired visual effect in the produced yarn, said method comprising:

continuously supplying at least one yarn component in the form of a bundle of continuous filaments;

individually texturizing the bundle of continuous filaments;

conveying the texturized bundle of continuous filaments to a collective compacting stage;

supplying at least one other yarn component from a source directly to the collective compacting stage;

collectively compacting the bundle of continuous filaments and the at least one other yarn component together in the collective compacting stage; and controlling thread tension such that at least one of the yarn components in the collective compacting stage has a thread tension that differs from the thread tension of the other yarn components.

2. The method as in claim 1, further comprising pre-compacting the bundle of continuous filaments before said texturizing.

3. The method as in claim 2, wherein said pre-compacting comprises one of a false twist or entangling compacting process.

4. The method as in claim 1, wherein said step of supplying at least one other yarn component comprises supplying the yarn component in the form of spun staple fibers.

5. The method as in claim 1, comprising supplying the bundle of continuous filaments directly from an extrusion beam.

6. The method as in claim 1, comprising supplying the bundle of continuous filaments directly from a package.

7. A method for producing a yarn from at least two individual yarn components wherein at least one physical characteristic of the yarn components is different so as to produce a desired visual effect in the produced yarn, said method comprising:

continuously supplying at least one yarn component in the form of a bundle of continuous filaments;

individually texturizing the bundle of continuous filaments;

conveying the texturized bundle of continuous filaments to a collective compacting stage;

supplying at least one other yarn component from a source directly to the collective compacting stage;

collectively compacting the bundle of continuous filaments and the at least one other yarn component together in the collective compacting stage;

controlling thread tension such that at least one of the yarn components in the collective compacting stage has a thread tension that differs from the thread tension of the other yarn components; and further comprising post-compacting the bundle of continuous filaments after said texturizing and before said collective compacting.

* * * * *